United States Patent [19]

Fohl

[11] 4,311,453

[45] Jan. 19, 1982

[54] HIGH VOLTAGE FLASHLAMP WITH IGNITION MEANS INCLUDING A PLURALITY OF SPARK GAP MEMBERS

[75] Inventor: Timothy Fohl, Carlisle, Mass.

[73] Assignee: GTE Products Corporation, Stamford, Conn.

[21] Appl. No.: 146,575

[22] Filed: May 5, 1980

[51] Int. Cl.[3] ..... F21K 5/02

[52] U.S. Cl. ..... 431/362

[58] Field of Search ..... 431/357, 358, 362, 365; 362/6, 11, 13, 15

[56] References Cited

U.S. PATENT DOCUMENTS

| | | | |
|---|---|---|---|
| 2,768,517 | 10/1956 | Atkinson et al. | 431/362 |
| 2,811,846 | 11/1957 | Rively | 431/362 |
| 3,220,225 | 11/1965 | Baird | 431/362 |
| 3,556,699 | 1/1971 | Takahashi et al. | 431/362 |
| 3,685,947 | 8/1972 | Meulemans et al. | 431/362 |
| 3,752,636 | 8/1973 | Warninck | 431/362 |
| 3,873,260 | 3/1975 | Coté | 431/362 |
| 3,873,261 | 3/1975 | Coté | 431/362 |
| 4,097,220 | 6/1978 | Cote | 431/362 |

*Primary Examiner*—Samuel Scott
*Assistant Examiner*—Lee E. Barrett
*Attorney, Agent, or Firm*—Lawrence R. Fraley

[57] ABSTRACT

A high voltage, electrically-activated flashlamp which includes an improved ignition means comprising a pair of lead-in wires, a glass or ceramic insulator positioned on the ends of the wires, and a plurality of spark gap members arranged in either an annular or linear pattern with the lamp's envelope for simultaneously igniting the lamp's shredded zirconium or hafnium combustible material. The spark gap members, each comprising a pair of spaced (or gapped) layers of aluminum or copper bridged by a small quantity of high voltage breakdown primer material, are electrically connected in series.

15 Claims, 4 Drawing Figures

HIGH VOLTAGE FLASHLAMP WITH IGNITION MEANS INCLUDING A PLURALITY OF SPARK GAP MEMBERS

DESCRIPTION

TECHNICAL FIELD

The present invention relates to flashlamps for use in photoflash devices and particularly to such lamps which are electrically activated.

Lamps of this type are generally classified into two varieties: low-voltage and high-voltage. Low-voltage photoflash lamps typically include a glass envelope with a combustion-supporting gas (e.g., oxygen) and a quantity of filamentary, combustible material (e.g., shredded zirconium) therein. A pair of electrically conductive lead wires are usually sealed in one end of the envelope and extend therein. A filament is utilized and interconnects the extending ends of the wires. When the filament is heated by a firing current usually generated from a low-voltage source such as a battery or charged capacitor (e.g., having a voltage of from about 1.5 to 15 volts), it ignites a primer material which then ignites the combustible material to produce a flash of light. Naturally, the oxygen gas aids in the above ignition. In high-voltage lamps, the use of a filament is usually excluded and a glass or ceramic bead is provided in which are located the extending ends of the lamp's conducting wires. A single quantity of primer material serves to bridge the portions of these two ends which project through the bead. High-voltage lamps usually also include the aforedescribed filamentary material and combustion-supporting gas. Flashing is accomplished by a firing pulse applied across the two wires and approaching a few thousand volts. Such a pulse is usually provided by a piezoelectric element found in many of today's cameras. In yet another type of high-voltage lamp, the primer is located within an indentation in the bottom of the lamp and the conductive wires extend therein.

The teachings of the present invention are particularly concerned with flashlamps of the high voltage variety and even more particularly with improved means for achieving ignition thereof.

BACKGROUND

Several techniques have been employed in the art to attempt successful (reliable, substantially instantaneous) ignition of high voltage flashlamps. In those lamps mentioned above which include a glass bead with the lead-in wires embedded therein, a single, relatively large mass of primer material was positioned on the bead to bridge the two ends of the wires. Application of the aforementioned high voltage pulse across the ends of the wires projecting externally of the lamp's envelope resulted in a voltage breakdown of the mass when a certain voltage level was reached. The previously non-conductive mass thus became highly conductive and ignited to in turn ignite the shredded zirconium or hafnium combustible material located within the envelope relative to the primer mass and glass bead. A particular problem with this type of ignition was that it usually occurred at a localized point in the primer and was relatively slow in spreading to the remainder of the mass. This often resulted in unacceptable variations in ignition times. In addition, variations in thickness, homogeneity, or drying temperatures for such large masses of material also served to alter the range of ignition voltages required to effect successful lamp firing. In another type of technique for igniting a high voltage flashlamp, only one of lamp's lead-in wires was coated with a porous insulating material and both wires then bridged by primer. This ignition, often referred to as of the discharge variety, was achieved by impressing a pulse of more than 10,000 volts across the externally projecting wires. Spark discharges were produced across the porous insulator between the lead coated with the insulating material and the primer material to ignite the latter. One problem with this type of lamp was the difficulty incurred in attempting to fully cover the one wire with insulating material. Yet another problem was the inherent requirement for such high voltages essential to achieve ignition.

In yet another flashlamp (of the discharge ignition type), only one of the lead-in wires projecting within the envelope was coated with an insulating material which in turn also served as a primer. The lamp's shredded combustible provided a conducting path between the primer and adjacent, uncoated wire. Again, difficulties were experienced in such a lamp due to the extreme difficulty in fully coating the one wire. There is also an inherent problem in any lamp ignition system which relies on the shredded combustible filaments to form part of the circuit thereof. On many occasions, electrical interconnection was prevented as a result of a shifting or settling of combustible at spaced locations within the envelope. Alternatively, when contact was provided, it was impossible to ascertain the extent to which such contact was achieved (e.g., number of shreds providing the conductive path), thus resulting in unacceptable variations in conductivity between different lamps.

It is believed, therefore, that a high voltage flashlamp which is capable of providing substantially instantaneous and reliable ignition without the several disadvantages of many presently known lamps as described above would constitute a significant advancement in the art.

DISCLOSURE OF THE INVENTION

It is a primary object of the present invention to enhance the art of electrically-activated flashlamps by providing such a lamp which includes an improved ignition means.

In accordance with a main aspect of the invention, there is provided an improved electrically activated flashlamp wherein the ignition means of said lamp comprises a pair of lead-in wires each having an end portion which extends within the lamp's envelope, an insulator member positioned on at least one of the wire ends, and a plurality of spark gap members arranged on the insulator in an electrical series relationship for being ignited in a substantially simultaneous manner to in turn rapidly and reliably ignite the lamp's combustible material (e.g., shredded zirconium) located relative thereto. Each spark gap member comprises a pair of electrical conductive members bridged by a single quantity of primer material possessing a relatively high breakdown voltage. The several, spaced-apart individual primers substantially simultaneously ignite upon application of a high voltage pulse across the two lead-in wires of the lamp which project from the lamp's envelope.

BEST MODE FOR CARRYING OUT THE INVENTION

For a better understanding of the present invention together with other and further objects, advantages and capabilities thereof, reference is made to the following disclosure and appended claims in connection with the above described drawings.

Figure 1:
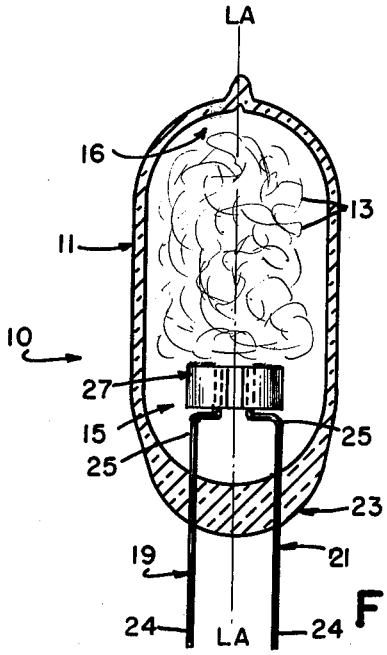
FIG. 1 is a front elevational view, in section, of an electrically activated high voltage flashlamp in accordance with a preferred embodiment of the invention.

With particular reference to FIG. 1, there is illustrated an electrically-activated flashlamp 10 for use in a multilamp photoflash device. Such devices, well known and available on the market today, including those referred to as "flip-flash" devices, are manufactured by the assignee of the instant invention. Said devices typically include several (e.g., eight or ten) flashlamps which in turn are usually arranged in either a planar or linear array. When the device is positioned within or atop a respective camera, sequential ignition of the flashlamps is achieved by the application of sequential high voltage pulses to the device's connecting terminal from the power source (e.g., a piezoelectric element) associated with the camera. A typical piezoelectric element provides a high voltage, low energy pulse approaching 5000 volts.

Lamp 10 includes an envelope 11 of light-transmitting material (e.g., borosilicate glass) and a quantity of filamentary combustible material 13 (e.g., shredded zirconium or hafnium). When using such material, lamp 10 also includes a combustion-supporting atmosphere (e.g., oxygen) therein, said atmosphere retained by hermetically sealing envelope 11 during manufacture thereof. The oxygen atmosphere is preferably established at several (e.g., eight) atmospheres. A typical quantity of shredded zirconium or hafnium is about 15 to 20 milligrams. When utilizing the aforementioned materials, quantities, etc., lamp 10 is capable upon ignition of providing an output of about 1800 beam candlepower seconds with a peaking time of approximately thirteen milliseconds. The lamp also operates at a color temperature of about 5000 degrees K.

It is also possible in the present invention to use combustible other than shredded zirconium or hafnium as the light-emitting material. For example, a flash-producing composition consisting of a powdered metal (e.g., zirconium) and powdered oxidizer (e.g., potassium chlorate) could be successfully employed, said composition located within envelope 11 adjacent the invention's ignition means 15 (described below). Examples of such powdered materials are defined in copending Application under Ser. No. 096,606 (Andre C. Bouchard, filed Nov. 21, 1979). It is understood that outputs from lamp 10 when utilizing the aforementioned powdered materials would be substantially less than those provided by the embodiment of the invention depicted in FIG. 1. As defined in Ser. No. 096,606, however, the outputs obtainable are satisfactory for devices used with cameras employing many of today's higher speed (e.g., ASA 400) films.

It is also possible in the instant invention to use a pyrotechnic charge as the light-emitting material for lamp 10. An example of such a material is described in copending application under Ser. No. 146,578 (Timothy Fohl and Andre C. Bouchard, filed May 5, 1980), filed concurrently herewith. This solid fuel (e.g., a 57/43 percent by weight mixture of zirconium and potassium perchlorate) would preferably be positioned within envelope 11 at a distant location (e.g., in the region of tip portion 16) from ignition means 15. It is understood in this case also that lamp outputs when using such pyrotechnic charges would be substantially less than those provided by a lamp having shredded zirconium or hafnium. The outputs obtainable, however, are sufficient for utilization with the aforementioned high speed films. It is further understood that use of flash-emitting materials which include their own oxygen supplier (e.g., potassium perchlorate) during ignition and burning thereof precludes the requirement for a combustion-supporting atmosphere within envelope 11, thus also eliminating the need for the aforementioned hermetic sealing of the envelope. The absence of a requirement for such a seal allows for use of light-transmitting material other than glass for envelope 11. Plastics such as polypropylene can be used.

In accordance with the teachings of the present invention, an improved ignition means 15 is provided for lamp 10 which assures safe, reliable, and substantially instantaneous ignition of combustible material 13 in a unique manner. As will be defined, ignition means 15 not only provides for a plurality of different ignition sources within envelope 11 but also for strategically orienting these sources relative to the combustible material to significantly improve ignition thereof over known techniques. As will also be described, this unique method of ignition is further enhanced by simultaneous ignition of the several, spaced sources. The invention thus combines features of positioning and timing to provide the described distinctive advantages.

Ignition means 15 comprises a pair of lead-in wires 19 and 21 which are secured within the press-sealed end 23 of envelope 11. Each wire, preferably of a nickel-iron alloy having a diameter of about 0.014 inch, includes a first end portion 24 which projects externally of the envelope and is adapted for having the aforedefined high voltage pulse impressed thereacross. Each wire further includes a second end portion 25 which extends within the envelope in the manner illustrated in FIG. 1. Wires 19 and 21 are preferably spaced apart a distance of 0.030 inch in press-sealed end 23 to provide stability (for reasons cited below). Ends 25 are bent at ninety degrees at two locations (see especially FIG. 2) such that the extreme portions thereof are aligned in parallel in the finished product with each other and the lamp's longitudinal axis LA—LA. Understandably, longitudinal axis LA—LA is that axis which passes through the center of envelope 11 and along its lengthwise dimension. As shown in FIG. 1, axis LA—LA also passes through the approximate center of shredded material 13.

Figure 2:
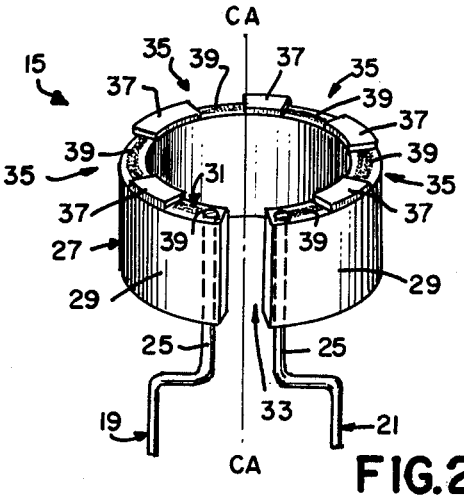
FIG. 2 is an enlarged, partial perspective view of the ignition means of the invention, as utilized in the flashlamp in FIG. 1.

Extending ends 25 are securely positioned within a substantially cylindrical insulator member 27 and pass therethrough (the longitudinal sides 29) to emerge at one end 31. Accordingly, insulator 27 is in effect positioned on ends 25 and therefore relative to combustible material 13 to provide ignition thereof in accordance with the teachings of the invention. Insulator 27 is comprised of glass or ceramic and has an external diameter of 0.20 inch with walls 29 possessing a thickness of 0.040 inch. To assure proper spacing between ends 25 of wires 19 and 21, a slot 33 is provided within the insulator and runs the entire length thereof (as shown in FIG. 2). Positioning of insulator 27 within envelope 11 is deemed important and in the embodiment of FIGS. 1 and 2, the insulator is oriented such that its central axis CA—CA (axis passing through the center of the cylindrical member) lies coincidentally with longitudinal axis LA—LA. In this arrangement, the planar end portion 31 of insulator 27 is oriented perpendicular to the aforementioned axes. In addition, the insulator is thus assured of being centrally disposed within the lower (bottom) portion of the lamp's envelope.

Positioned on end 31 of insulator 27 are a plurality of spark gap members 35 which are connected in an electrical series relationship are arranged in a substantially annular (ringlike) configuration about end 31. The respective end portions of this arrangement are electrically coupled to a respective end 25 of wires 19 and 21. Application of the aforementioned high voltage pulse to wires 19 and 21 results in simultaneous ignition of spark gap members 35 which in turn causes substantially instantaneous ignition of combustible 13 located nearby. By the term spark gap member is meant a pair of spaced-apart electrically conductive members 37 having their spacing (or gap) bridged by a relatively small quantity (e.g., less than 2 milligrams) of primer material 39. A small quantity of primer 39 also serves as the coupler between each of the exposed extreme ends of wires 19 and 21 and the respective end of the series-arranged spark gap members 35. Although four such members are shown in FIG. 2, it is understood that this number can vary. A preferred number of such members is within the range of two to ten. It is also understood with regard to FIG. 2 that some of the conductive members 37 may serve a common function; that is, some may constitute one of the conductors for two or more different spark gap members.

The primer material 39 for use with the invention is preferably any of those known within the state of the art as having a relatively high (e.g., from about 100 to about 1000 volts) breakdown voltage. Such primers, typically including a composition of zirconium, potassium perchlorate, and nitrocellulose in preestablished ratios, are well known in the art and further definition is not deemed necessary. In operation, each primer 39 is substantially dielectric (or nonconductive) until the predetermined voltage is reached. Thereafter, the material "breaks down" and becomes an efficient conductor to the point of ignition thereof. This entire sequence occurs almost instantaneously, of course, as a result of the corresponding instantaneous impression of the defined high voltage pulse from the camera's piezoelectric element across wires 19 and 21. All primers 39 have substantially the same breakdown voltage (within the range cited above) and are thus assured of substantially simultaneous ignition.

Electrically conductive members 37 are each thin (e.g., less than 0.005 inch thick) layers of copper or aluminum which is preferably vapor-deposited or similarly applied to end 31 prior to depositing of the defined primers 39. As illustrated, each member 37 has a width approximately equal to that of the corresponding thickness of walls 29 of insulator 27. In addition, each member has a mean, arcuate length of about 0.110 inch. The invention as depicted in FIG. 2 thus illustrates the strategic locating of a plurality of spaced ignition masses relative to the shredded combustible material 13 of a high voltage flashlamp. To prevent the possibility of shred interaction (e.g., short-circuiting between different conductive members and/or primers), it is preferred to provide a suitable insulating material between the spark gap members and combustible. Such a material, not shown, could be in the form of a disc located atop members 35 or a coating sprayed on the finished, series arrangement as shown in FIG. 2. Insulating materials capable of providing this feature are known in the art and further definition is not deemed necessary.

Figure 3:
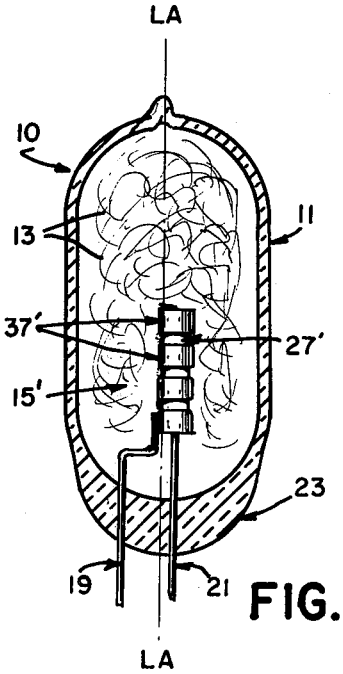
FIG. 3 is a front elevational view, in section, of an electrically activated flashlamp in accordance with another embodiment of the invention.
Figure 4:
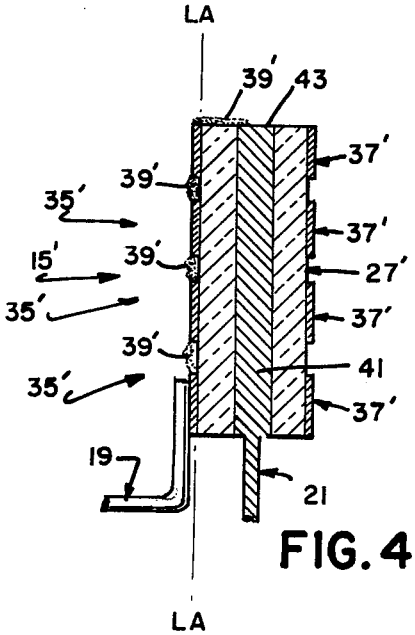
FIG. 4 is an enlarged, partial elevational view, in section, of the ignition means as used in the improved flashlamp of FIG. 3.

In the lamp of FIGS. 3 and 4, there is illustrated an ignition means 15′ in accordance with an alternate embodiment of the invention. Means 15′ includes cylindrical glass or ceramic insulator 27′ which is substantially elongated in comparison to the insulator in FIGS. 1 and 2 and also has a smaller outer diameter. By way of specific example, insulator 27′ possesses a length of 0.20 inch, and outer diameter of 0.10 inch, and a corresponding wall thickness of 0.040 inch. This cylindrical member is positioned about and antiguous to an elongated conductor 41 which in turn is connected to or forms a part (extension) of the extending end of wire 21. In one embodiment, member 41 is solid copper or aluminum component and secured (e.g., soldered) to the extreme end of the nickel-iron alloyed wire 21. Each of the spaced-apart conductive members 37′ are in the form of annular (ringlike) layers formed about the outer surface of insulator 27′. Each has a thickness similar to that of members 37 in FIG. 2 and is spaced about 0.010 inch from the next, adjacent such member. Bridging each adjacent pair of these members is a small quantity 39′ of the aforedefined primer material. A like quantity also serves to couple the exposed end portion 43 of conductor 41 with an annular conductive member located immediately adjacent thereto. The remaining lead-in wire 19 is also doubly bent in the same manner as wires 19 and 21 in the embodiment of FIGS. 1 and 2, and is secured (e.g., soldered) to the end (bottom) conductive member 37′ to assure the requisite closed circuit for ignition means 15′.

The means 15′ of FIGS. 3 and 4 is also strategically oriented within envelope 11 to assure instantaneous, multi-point ignition of combustible 13. Specifically, the primers 39′ which each constitute a part of the respective spark gap members 35′ in FIGS. 3 and 4 are arranged in a substantially linear pattern such that each primer lies along the described longitudinal axes LA—LA of envelope 11. Accordingly, each primer is thus assured of being substantially centrally disposed within the envelope. The aforedescribed potentially adverse shred interaction can be prevented by utilization of the described insulative material between members 35′ and combustible 13. Each of the spark gap members of the linear embodiment of FIGS. 3 and 4 possess substantially identical breakdown voltages within the range of about 100 to about 1000 volts.

Thus there has been shown and described an improved high voltage flashlamp wherein the improvement rests in an ignition means capable of rapidly and reliably igniting the lamp's combustible material in a manner heretofore unknown in the prior art. As defined, the ignition means of the invention provides several spaced-apart ignition points within the lamp which are designed for being substantially simultaneously fired to in turn ignite said combustible. As further defined, a key feature of the invention involves the strategic positioning of the ignition points relatively to the combustible to even further assure enhanced ignition thereof.

While there have been shown and described what are at present considered the preferred embodiments of the invention, it will be obvious to those skilled in the art that various changes and modifications may be made therein without departing from the scope of the invention as defined by the appended claims.

What is claimed is:

1. In an electrically-activated flashlamp including a light-transmitting envelope, a quantity of light-emitting combustible material within said envelope, and ignition means for igniting said light-emitting combustible material, the improvement wherein said ignition means comprises:

a pair of lead-in wires secured within said envelope, each of said lead-in wires having an end portion extending within said envelope;

an insulator member positioned on at least one of said extending ends of said lead-in wires and oriented within said envelope relative to said light-emitting combustible material; and a plurality of spark gap members located on said insulator in a predetermined pattern, said spark gap members arranged in an electrical series relationship and electrically coupled to said extending end portions of said lead-in wires for igniting in a substantially simultaneous manner upon application of a high voltage pulse across said lead-in wires, each of said spark gap members comprising a pair of spaced-apart electrically conductive members bridged by a quantity of primer material.

2. The improvement according to claim 1 wherein said insulator member is substantially cylindrical in configuration.

3. The improvement according to claim 2 wherein said spark gap members are arranged in said predetermined pattern on an end surface of said substantially cylindrical insulator member, said pattern substantially annular in configuration.

4. The improvement according to claim 3 wherein each of said extending ends of said lead-in wires is securedly positioned within said insulator member and electrically coupled to a respective end of said annular pattern of spark gap members.

5. The improvement according to claim 3 wherein said light-transmitting envelope includes a longitudinal axis and said substantially cylindrical insulator member includes a central axis, said longitudinal axis and said central axis being coincidentally oriented.

6. The improvement according to claim 5 wherein said substantially annular pattern of spark gap members is located on said insulator member adjacent said light-emitting combustible material.

7. The improvement according to claim 2 including an elongated conductor member connected to or forming an extension of the extending end of a first of said lead-in wires.

8. The improvement according to claim 7 wherein said substantially cylindrical insulator member is positioned about said elongated conductor member.

9. The improvement according to claim 8 wherein each of said electrically conductive members of said spark gap members is of a substantially annular configuration located about the longitudinal sides of said cylindrical insulator.

10. The improvement according to claim 9 wherein said quantities of primer material bridging said annular electrically conductive members are arranged on said insulator member in a substantially linear pattern.

11. The improvement according to claim 10 wherein said light-transmitting envelope includes a longitudinal axis, said linear pattern of said quantities of primer material lying on said longitudinal axis.

12. The improvement according to claim 1 wherein the number of spark gap members is within the range of about 2 to about 10.

13. The improvement according to claim 1 wherein each of said quantities of primer material has a breakdown voltage within the range of about 100 to about 1000 volts.

14. The improvement according to claim 1 wherein each of said electrically conductive members comprises a thin layer of metallic material.

15. The improvement according to claim 14 wherein said metallic material is selected from the group consisting of aluminum and copper.

* * * * *